United States Patent [19]

Harrison et al.

[11] Patent Number: 4,909,917

[45] Date of Patent: Mar. 20, 1990

[54] ELECTROLYTIC TREATMENT APPARATUS

[75] Inventors: Robert H. Harrison, Faringdon; John M. Jackson, Potters Bar; Roger Wilkins, Stevenage, all of United Kingdom

[73] Assignee: CMP Packaging (UK) Limited, United Kingdom

[21] Appl. No.: 351,635

[22] Filed: May 15, 1989

[30] Foreign Application Priority Data

May 20, 1988 [GB] United Kingdom ..... 8811982

[51] Int. Cl.[4] ..... C25D 17/06; C25D 17/08

[52] U.S. Cl. ..... 204/199; 204/218; 204/228; 204/297 R; 204/297 W; 204/299 EC; 204/300 R; 204/300 EC

[58] Field of Search ..... 204/199, 218, 228, 297 R, 204/297 W, 299 EC, 300 R, 300 EC

[56] References Cited

U.S. PATENT DOCUMENTS 2,448,117 8/1948 Pearson et al. ..... 204/200
3,849,284 11/1974 Kossmann ..... 204/300 R
4,659,445 4/1987 Bogdan et al. ..... 204/300 EC

FOREIGN PATENT DOCUMENTS 60-21395 6/1985 Japan .
1361657 7/1974 United Kingdom .

*Primary Examiner*—T. Tung
*Assistant Examiner*—David G. Ryser
*Attorney, Agent, or Firm*—Diller, Ramik & Wight

[57] ABSTRACT

An apparatus for electro-coating disc-like workpieces (can ends for food cans) comprises an electrolyte tank and a carrier wheel mounted for rotation with one third of its periphery in the electrolyte. The wheel carries equi-spaced pallets, each defining a pocket for holding a workpiece with its periphery in good electrical contact with the pallet while the pallet is carried by the wheel through the electrolyte adjacent a counter electrode. Energisation of the pallets is achieved by sliprings each having three conductive segments connected to respective pallets spaced equally around the wheel. Adjacent segments in adjacent sliprings are staggered for sequential energisation of the pallets while submerged in the electrolyte. Electrical control means (a) test for the presence of a workpiece in a pocket, and for the degree of workpiece contact with its pocket, and (b) control the electric current passing to each separate pallet.

23 Claims, 6 Drawing Sheets

ELECTROLYTIC TREATMENT APPARATUS

This invention relates to electrolytic treatment apparatus for electrolytically treating disc-like metal workpieces, and particularly but not exclusively to such apparatus for electro-phoretically coating (electro-coating) workpieces such as can ends for use in the manufacture of metal cans for food and beverage storage.

Patent specification GB 1,361,657 discloses an apparatus for electro-coating circular metal parts having raw, cut edges, such as can ends, with a resinous, organic coating material. That apparatus comprises and electro-coating bath for containing the resinous organic material; an electrically energisable first guide member situated above the electro-coating bath; and a non-conducting, second guide member disposed in the bath. The guide members define a pair of vertically aligned grooves for receiving and guiding can ends which are rolled on edge between them by virtue of the movement of one of the guide members. The movable guide member comprises either a endless belt, or alternatively the periphery of a rotatable wheel. The groove in the energisable guide member is shaped so as to effect a rolling, wiping electrical contact with the raw, cut edge of each can end, so that as each can end progresses through the bath of coating material, it becomes electro-phoretically coated with resinous material. In both embodiments disclosed in that specification, the can ends act as anodes to a cathode immersed in the bath of coating material.

One disadvantage of these prior art arrangements lies in the fact that the can ends being rolled through the bath of electro-coating material are simultaneously energised in a parallel manner from the same energising guide member, so that it is not possible to separately monitor and control the current, and hence the quantity of electrical charge, passing to each individual can end. In this connection, it is to be noted that the current flowing to a can end is inversely proportional to the electrical resistance of the coating already deposited on the can end surfaces. Hence, a poorly coated can end will permit a high current to flow to it, whilst a well coated can end will pass little or even no current.

To ensure uniformity in the coated can ends passing through such a bath of coating material, it is advantageous to be aware at all times of the state of each can end undergoing electro-coating, and to exercise individual control over the currents flowing to the respective can ends so as to permit the coating process to continue only so long as necessary for each particular can end.

U.S. Pat. No. 4,659,445 discloses an apparatus for electro-coating metal can bodies. In that apparatus, can bodies are loaded on to the peripheral parts of a rotatable carrier wheel which has its lower portion submerged in an electro-coating fluid contained in a tank below the carrier wheel. Rotation of the wheel carries each can body in turn down into, through and out of the electro-coating fluid. Whilst each can body is submerged in the electro-coating fluid, electro-coating material is deposited on the can body by virtue of the electrical energisation of the carrier wheel and the can bodies carried thereon relative to a counter electrode which is likewise submerged in the electro-coating fluid.

In FIG. 1, the carrier wheel shaft is submerged in the electro-coating fluid, and the can bodies are gripped at their open ends by mechanical grippers carried by the carrier wheel, with the open ends of the can bodies facing radially inwards.

In FIG. 2, the carrier wheel shaft is disposed wholly above the free surface of the electro-coating fluid, and the can bodies are held magnetically at their closed ends by magnetic carriers which are pivotally secured on the carrier wheel, and which are pivoted as the carrier wheel rotates so as reverse the disposition of the can bodies, so that their open ends face radially inwards.

As in the apparatus of the above-mentioned British patent specification, all of the can bodies carried into the electro-coating fluid are energised simultaneously and in a parallel manner whilst in the fluid, so that it is not possible to monitor and control the electro-coating of the respective individual can bodies, whereby to ensure uniform electro-coating of the respective can bodies. The present invention seeks to overcome this deficiency, and thus to provide an apparatus in which the electro-coating of each successive can body can be individually monitored and controlled to achieve the desired electro-coating of each specific can body.

The present invention is concerned with an electrolytic treatment apparatus for electrolytically treating metal workpieces, which apparatus comprises:

(a) an electrolyte tank for receiving a filling of electrolyte reaching up to a predetermined electrolyte surface level;

(b) a rotatable carrier wheel carried for rotation on a shaft which lies wholly above the electrolyte surface level, the carrier wheel having part thereof reaching down into the tank below the electrolyte surface level so that on rotation of the carrier wheel successive peripheral portions of the carrier wheel travel temporarily below the electrolyte surface level during each revolution of the carrier wheel;

(c) a plurality of workpiece carriers (or pallets) secured on the carrier wheel at positions spaced uniformly around the periphery of the carrier wheel, the workpiece carriers being arranged to receive therein respective workpieces in radially-facing positions;

(d) a counter-electrode disposed in the electrolyte tank below the electrolyte surface level; and (e) energising means for electrically energising the workpiece carriers relative to the counter-electrode from an electrical supply source, thereby in the presence of a filling of electrolyte in the tank to electrolytically treat workpieces as they are carried temporarily through the electrolyte on rotation of the wheel.

According to the present invention, such an apparatus is characterised in that (i) the workpiece carriers are arranged to receive disc-like workpieces and are electrically insulated from the carrier wheel and from one another; and (ii) the energising means includes (a) a plurality of electrically conductive sliprings carried on the shaft for rotation with the carrier wheel, the sliprings being electrically connected with the respective workpiece carriers, and (b) a plurality of electrical brushes which engage the respective sliprings for electrically energising the respective sliprings and their associated workpiece carriers when the brushes are electrically energised relative to the counter-electrode.

Preferably, each slipring is electrically conductive over only a predetermined circumferential portion of its peripheral surface, which portion is positioned in relationship to the associated workpiece carrier and the associated brush so as to electrically energise the associated workpiece carrier only during its travel below the electrolyte surface level during each revolution of the carrier wheel, a complementary circumferential portion of the slipring peripheral surface being electrically non-conductive.

Advantageously, each conductive surface portion of a slipring is of such circumferential length that the associated workpiece carrier is energised for substantially the whole of the travel of that workpiece carrier below the electrolyte surface level during each revolution of the carrier wheel.

The non-conductive surface portion of each of a plurality of selected sliprings may conveniently be replaced, in part, by one or more correspondingly-positioned conductive surface portions of other such sliprings, thereby (a) to energise two or more workpiece carriers in spaced succession from each selected slipring and its associated brush during each revolution of the carrier wheel, and (b) to reduce the number of separate sliprings and associated brushes otherwise required for energising the workpiece carriers.

In general, where (a) the carrier wheel carries 'x.N' workpiece carriers ('x' and 'N' both being integral), and (b) the electrolyte surface level is positioned such that at least 'N' workpiece carriers lie below the electrolyte surface level, maximum advantage is obtained when 'N' sliprings, each having 'x' conductive porions, are used. In a preferred arrangement, 'x' has the value '3'.

An electrolytic treatment apparatus according to the present invention may also include any suitable combination of the optional features set out below:

(i) the carrier wheel comprises (a) a pair of discs spaced apart to define between them an annular cavity, and (b) a generally cylindrical peripheral member secured to the discs so as to encircle the annular cavity;

(ii) the cylindrical peripheral member comprises a plurality of axial segments lying circumferentially adjacent one another;

(iii) each workpiece carrier is secured to the cylindrical peripheral member so as to extend sideways from the carrier wheel;

(iv) each workpiece carrier incorporates an aperture which defines a workpiece pocket for receiving and supporting the peripheral part of a disc-like workpiece thereby to expose opposite radially-facing surfaces of the workpiece to electrolyte;

(v) half of the workpiece carriers are arranged so as to extend to one side of the carrier wheel, and the other workpiece carriers are arrange to extend to the opposite side of the carrier wheel;

(vi) each workpiece pocket includes an annular contact surface arranged so as to electrically contact a peripheral, exposed edge portion of a workpiece;

(vii) the cylindrical peripheral member carries a plurality of electrical terminals, to which the respective workpiece carriers and their respective associated sliprings, or conductive surface portions thereof, are electrically connected;

(viii) the carrier wheel shaft has a central bore which communicates with the annular cavity of the carrier wheel, and electrical cables extend through that bore and annular cavity to interconnect the said terminals with their respective sliprings, or conductive surface portions thereof;

(ix) the counter electrode comprises at least one arcuate electrode disposed concentrically with the carrier members;

(x) the counter electrode comprises two arcuate electrodes disposed respectively on opposite sides of the carrier wheel, each such arcuate electrode being disposed concentrically with an adjacent circle of carrier members extending from the carrier wheel;

(xi) the or each counter electrode is magnetic, or incorporates or has associated therewith an arcuate magnetic member, which magnetic counter electrode or magnetic member is positioned so as to attract and firmly hold in position ferro-magnetic workpieces when carried in the respective workpiece pockets thereby to ensure good electric contact of the workpieces with the associated workpiece carriers;

(xii) the or each arcuate counter electrode is disposed radially inwards of the adjacent workpiece carriers; and (xiii) additional arcuate counter electrodes are disposed radially outwards of the adjacent workpiece carriers.

Electrolytic treatment apparatus according to the present invention may include a filling of an electro-coating fluid reaching up to the said electrolyte surface level, and be used for electro-coating disc-like metal workpieces.

Other features of the present invention will appear from a reading of the description that follows hereafter, and from the claims appended at the end of that description.

One electro-coating apparatus, and various modifications thereof, all according to the present invention, will now be described by way of example, and with reference to the accompanying diagrammatic drawings. In those drawings.

Figure 1:
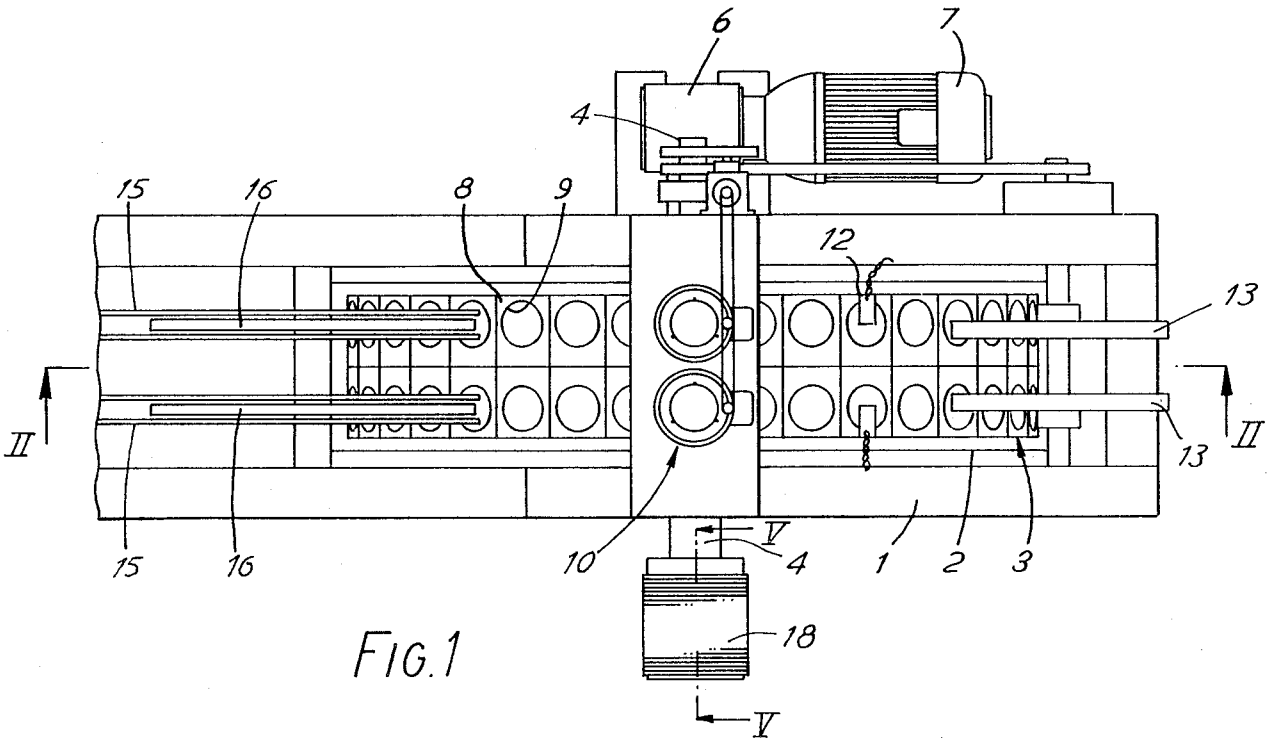
FIG. 1 shows a plan view of the relevant parts of the apparatus.
Figure 3:
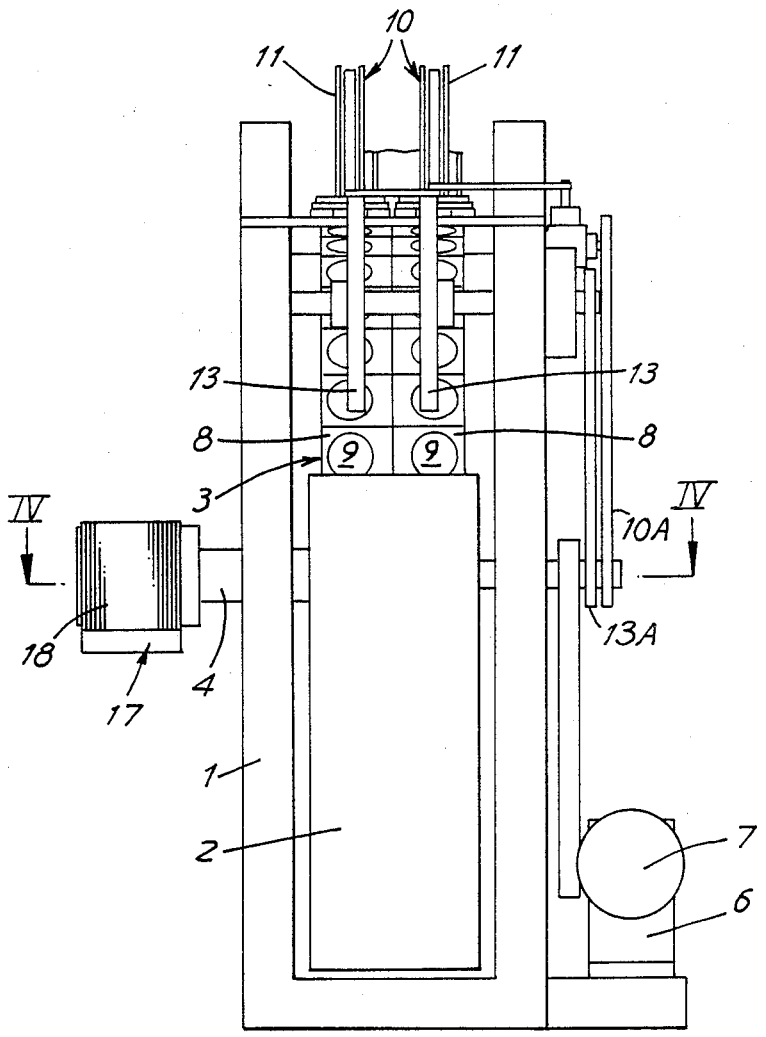
FIG. 3 shows an end elevation of the apparatus, as seen from the right hand side of FIG. 2.
Figure 5:
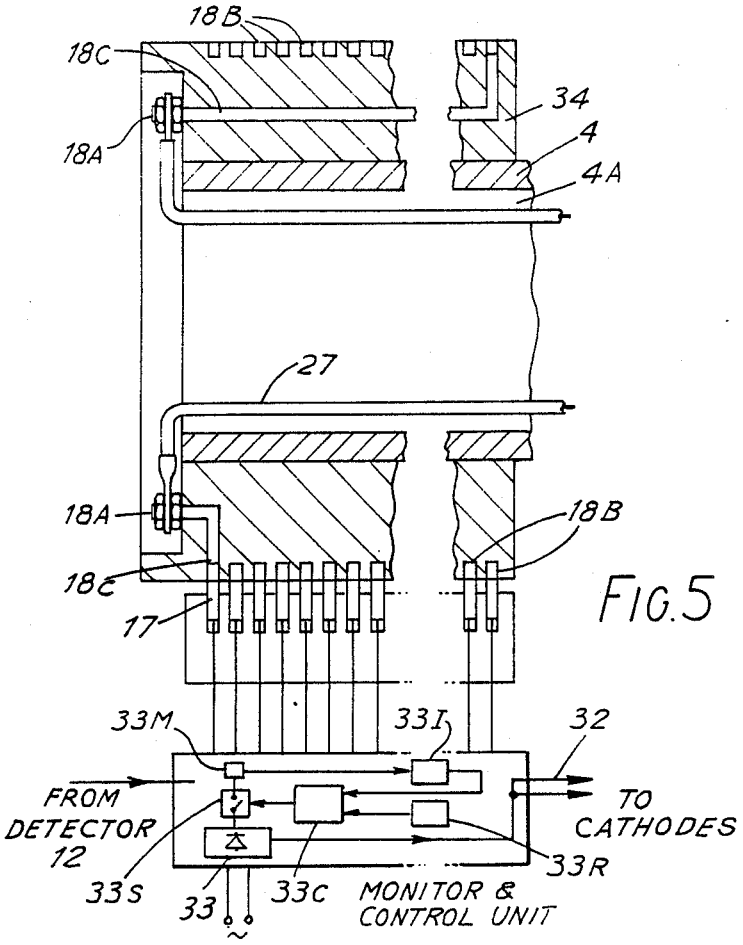
FIG. 5 shows an enlarged framentary sectional view of a slipring arrangement shown in FIGS. 1 and 3, taken on the vertical section V—V indicated in FIG. 1.
Figure 6:
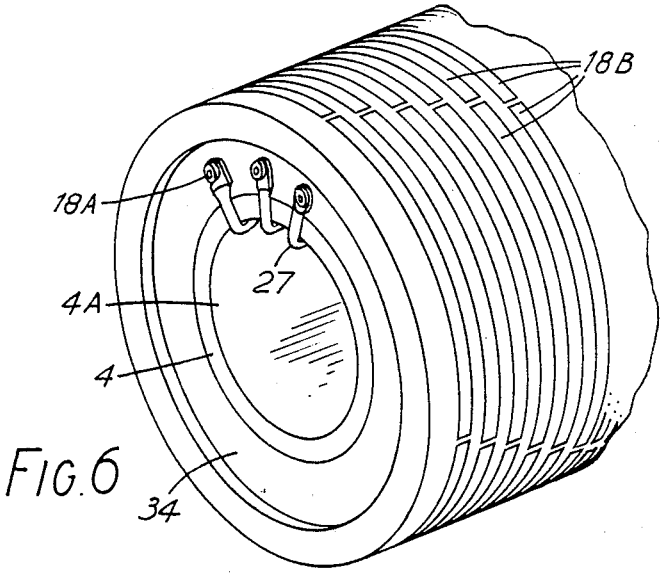
Figure 7:
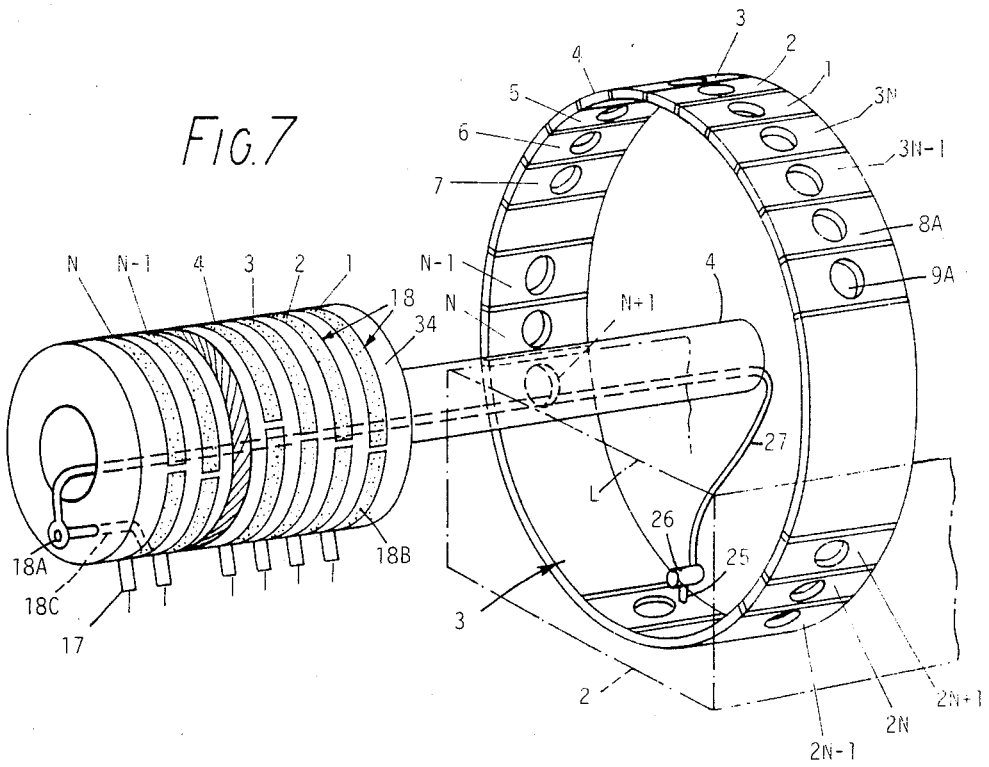

FIG. 6 shows an enlarged perspective view of part of the slipring arangement shown in the FIGS. 1, 3 and 5, and illustrates the staggered relationship of various electrically conductive segments forming part of the respective sliprings; and FIG. 7 shows a diagram illustrating the manner of connecting various workpiece carriers of the apparatus to respective conductive segments of the respective sliprings of the slipring arrangement.

Figure 2:
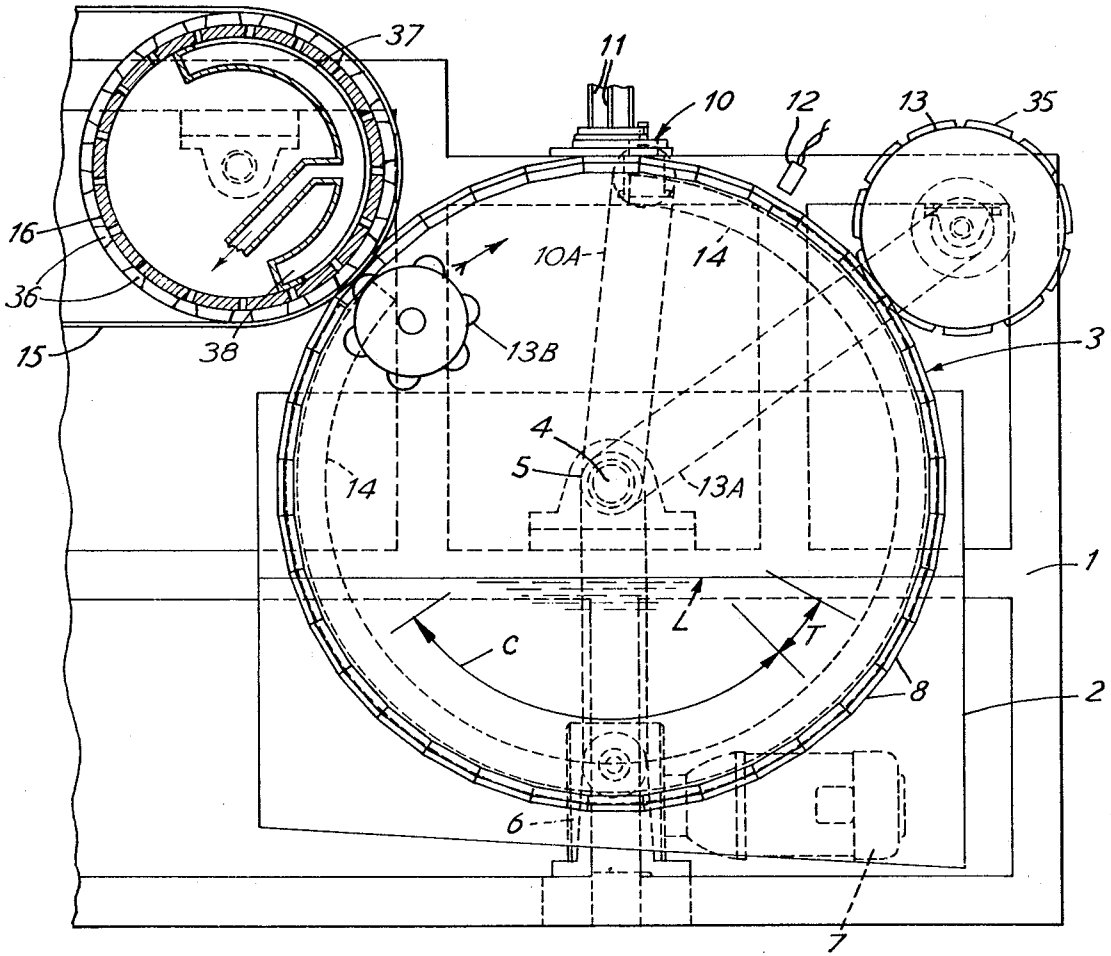
FIG. 2 shows a sectional view looking on the vertical section II—II indicated in FIG. 1.

Referring now to the FIGS. 1 to 3, the apparatus there shown comprises a frame 1 which supports an electrolyte tank 2, and above it, a rotatable carrier wheel 3. That wheel is carried for rotation on a driving shaft 4 which is mounted in bearings 5 carried on the frame 1. Only the lower part of the carrier wheel 3 dips down below the free surface level 'L' (see FIG. 2) of an electro-coating fluid contained in the tank 2. The driving shaft 4 is coupled through a speed reducing gear box 6 to an electric driving motor 7.

The carrier wheel 3 has secured around its peripheral portion two parallel circles of workpiece carriers (or pallets) 8 of a conductive metal. Each such pallet incorporates a circular aperture 9 which constitutes a workpiece pocket for receiving workpieces in the form of 'can ends' for use in the manufacture of metal cans for food and beverage storage. Such can ends are generally disc-like and are fed to the respective pockets, as the carrier wheel rotates, by a workpiece feeding unit 10. That unit, driven by a belt 10A from the carrier wheel shaft 4, includes two vertical stacks of can ends confined by groups of upright rods 11, and is arranged to feed the bottom can end from each such stack into the next free workpiece pocket as it comes into line with the stack.

As the carrier wheel rotates, clockwise as seen in FIG. 2, the respective pallets 8 pass beneath respective workpiece detectors 12 which check for the presence/absence of a workpiece in each passing pallet. Each detector supplies an output signal to a control unit 33 (shown in FIG. 5) indicative of the presence or absence of a workpiece in a pallet passing thereby. That signal is stored in the control unit 33. A 'can end absent' signal acts to inhibit the later energisation of an empty pallet when slipring control means (likewise shown in FIG. 5 and to be described later) signifies that that pallet has become submerged in the electro-coating bath and should be energised to effect electro-coating.

Continued rotation of the carrier wheel causes each pair of adjacent pallets in turn to pass below respective pressure rolls 13, which are driven by a belt 13A from the carrier wheel shaft 4 and which press the workpieces lodged in the respective pockets 9 more firmly into position in those pockets.

Arcuate magnetic rails 14 disposed concentrically with and radially inwards of the pallets 8 assist in positioning ferrous workpieces by magnetically pulling them firmly into good electrical contact with annular contact surfaces provided by upstanding beads 28 formed in the respective pockets 9.

Further rotation of the carrier wheel 3 carries each pair of pallets in turn below the free surface 'L' of the electrolyte contained in the tank 2, and the control unit 33 thereupon operates to pass an initial, electric 'test' current, via said slipring control means, between each newly immersed workpiece and the adjacent arcuate magnetic rail 14. That rail is connected for energisation as a counter-electrode in both this initial test and in the subsequent electro-coating process that is about to commence in the event that favourable circuit conditions are found to exist. This test energisation is carried out during rotation of the carrier wheel 3 through the angle designated 'T' in FIG. 2.

During that short test period, the control unit 33 performs an electrical circuit resistance test so as to ascertain whether circuit conditions satisfactory for the commencement of the electro-coating process exist, i.e whether the workpiece is in good electrical contact with the pocket in which it is disposed. In the event that satisfactory conditions are found to exist, the electro-coating process is carried out, under the control of the control unit 33 and the slipring control means, during rotation of the carrier wheel 3 through an angle which has as a maximum value the angle designated 'C' in FIG. 2, that is before the workpiece is lifted out of the electro-coating fluid.

After completion of the electro-coating process, continued rotation of the carrier wheel carries each pair of pallets beneath a workpiece outfeed device, which comprises a magnetic belt 15 carried on a driving pulley wheel 16. The latter device is synchronised to the carrier wheel shaft 4 by electrical or mechanical means not shown. As each pair of workpieces arrives adjacent the magnetic belt 15, the magnetic influence of the counter electrode rails 14 is overcome and the coated workpieces are magnetically attracted to and are carried away by the magnetic belt 15.

The apparatus described above can be used for a variety of electro-coating treatments, and with a suitable change of electolyte, for various other electrolytic treatments, such as electro-plating. However, such apparatus is particularly suited to the application (by electro-phoresis) of repair coatings to metal can ends after they have been produced by mechanical punching and pressing operations from metal feedstock sheet, which may have been pre-coated, or un-coated.

Figure 4:
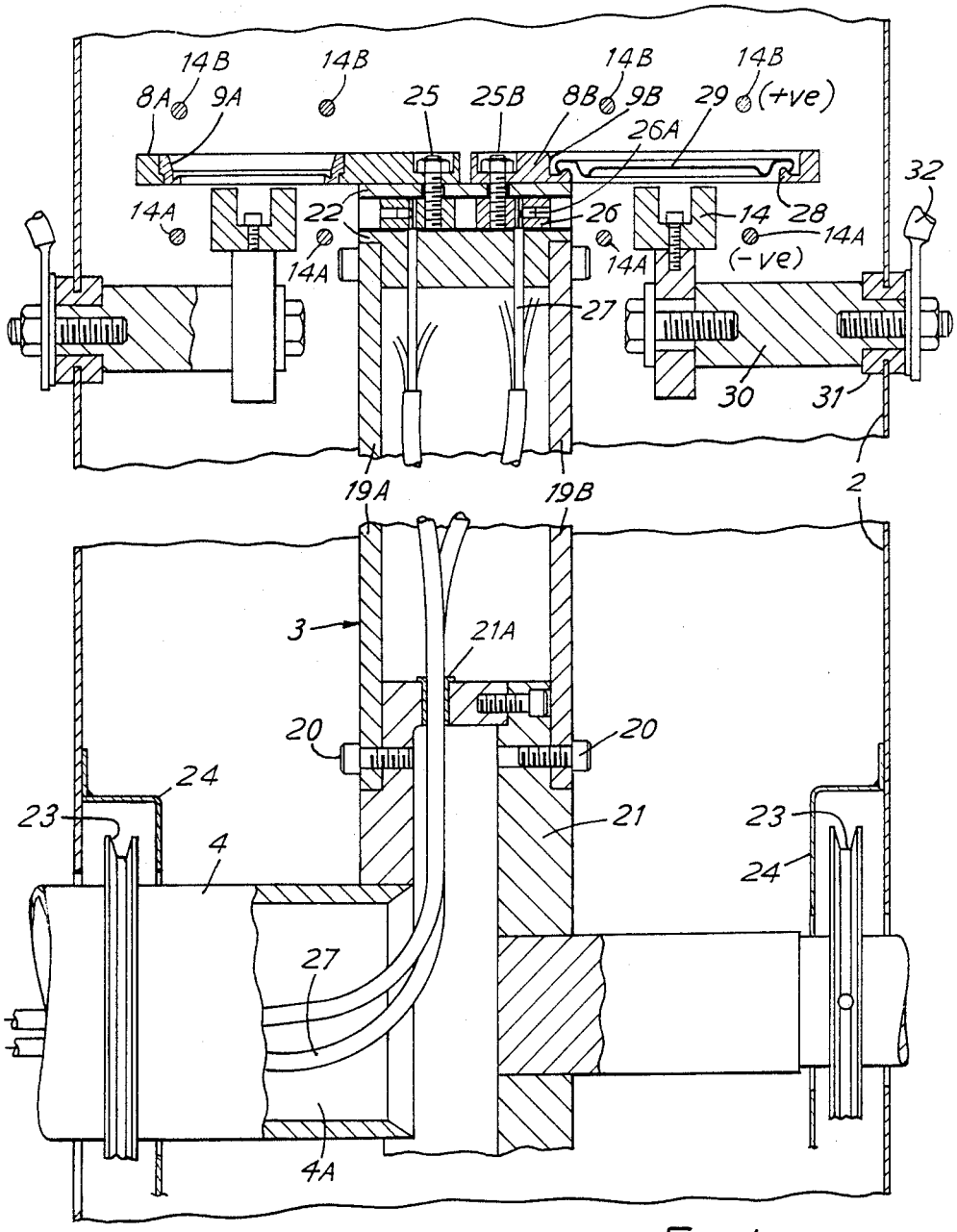
FIG. 4 shows an enlarged fragmentary sectional view looking on the horizontal section IV—IV indicated in FIG. 3.

FIG. 4 shows in detail the various parts of the carrier wheel 3 and the tank 2 which participate in the electro-coating process. In that Figure, the carrier wheel 3 comprises a pair of axially spaced annular plates or discs 19A, 19B which are secured by bolts 20 to a hub 21 which forms part of the carrier wheel shaft 4. The two plates 19A, 19B are secured by bolts to opposite ends of a short, thick-walled, generally cylindrical, peripheral member 22 (which in the embodiment shown is constituted by a plurality of plane, axial segments disposed circumferentially adjacent one another), and define between them an annular cavity. That cavity communicates through radial holes 21A formed in periphery of the hub with the bore 4A of the non-driving part of the shaft 4, which part carries outboard of the tank 2 a slipring assembly which comprises a set of sliprings 18 carried on an insulating tubular support 34 (see FIGS. 5 and 6).

To prevent loss of electro-coating fluid along the shaft 4, that shaft is provided inboard of the respective side walls of the tank 2 with respective flinger wheels 23 which are enclosed in cowls 24 for catching and returning to the electrolyte bath any electrolyte flying off the flinger wheels.

The respective workpiece carriers 8 are denoted in FIG. 4 by the references 8A and 8B respectively, and are shown secured by metal studs 25, 25B which extend in an electrically insulated manner through radial holes formed in the respective segments constituting the peripheral member 22 and which are held captive in electrical connectors 26. Those connectors are themselves secured in an insulated manner in axial holes formed in the respective segments constituting the peripheral member 22, and have radial holes in which the ends of respective cables 27 are disposed and clamped by grub screws 26A. Those cables extend in a fluid-tight manner through the radial holes 21A in the hub 21, and then extend along the dry bore 4A of the shaft 4 to the slipring assembly carried at the end of that shaft. There they are secured on respective connection studs 18A which protude axially from the slipring assembly and are connected with respective conducting segments 18B of the various sliprings 18.

The workpiece carriers 8A and 8B are shown in FIG. 4 as being of different sizes, and are intended to receive workpieces of correspondingly different sizes. However, if desired, the workpiece carriers may be replaced by other such carriers intended to receive other workpieces of equal sizes.

The pallet 8B is shown in FIG. 4 as confining the periphery of a can end 29. Actual electrical contact with the can end is made between the raw, cut edge of the can end 29 and an annular contact surface of a bead 28 which reaches up inside the peripheral curled part of the can end.

As shown in the upper part of FIG. 4, the arcuate rails 14 act as both (a) magnetic retaining means to hold the can ends 29 in contact with the pocket beads 28, and (b) as cathodes, being negatively energised relative to the adjacent circle of pallets 8 and can ends 29. Those rails are supported in the tank 2 by electrical terminal blocks 30 which are themselves carried in electrically insulating grommets 31 which extend through the wall of the tank. Cables 32 connect the terminal blocks 30 with the control unit 33 shown in FIG. 5.

If the electrolyte to be used in the tank for any particular electrolytic treatment is corrosive to magnetic materials, the magnetic rail may be clothed in a corrosion-proof protective sheath, and an exposed arcuate electrode may be provided alongside the sheathed magnetic rail.

If desired, two separate arcuate cathodes 14A may be placed alongside each arcuate rail 14 (which then serves only as a magnetic retaining means) radially inwards of the pallets 8A and 8B, whilst other pairs of arcuate cathodes 14B may be placed radially outwards of the pallets 8A and 8B.

The control unit 33 is arranged to receive control signals from the respective can end detectors 12. As mentioned earlier, if such a detector provides a 'can end absent' signal, the control unit 33 is inhibited from energising the relevant pallet 9 at the appropriate later time. On the other hand, in the presence of a 'can end present' signal from a detector 12, the control unit 33 passes temporarily a small test current to the relevant pallet 8 to ascertain whether the workpiece is in good electrical contact with the annular bead 28 in the pallet.

If the test indicates that the workpiece is in good electrical contact with its pallet, the control unit 33 fully energises the pallet and workpiece relative to the adjacent cathode rail 14, via the appropriate slipring 18, to electro-coat the can end. If for some reason, a workpiece is incorrectly seated in the pallet pocket, the resultant test signal inhibits the control unit 33 so that it is unable to supply an electro-coating current to the pallet.

Whilst it is possible to provide a separate conductive slipring 18 and associated brush 17 for feeding each individual pallet 8, such an arrangement would be bulky, expensive and preferably require a timing means for defining the periods in which the relevant pallet is submerged in the electro-coating fluid.

However, since each pallet 8 remains submerged in the electro-coating fluid for approximately one third of a carrier wheel revolution, and no benefit derives from energising a pallet when it is not so submerged, it is possible in a more compact slipring assembly to energise a pallet from one of three similar arcuate conductive segments 18B which together form a single slipring 18. Each such segment 18B is electrically insulated from the others, and spans approximately one third of the circumference of the slipring. The three segments of each such slipring are electrically connected with respective pallets 8 that lie spaced apart on the carrier wheel at an angular pitch of 120°, and corresponding segments in adjacent sliprings are staggered relative to one another by the angular pitch of the pallets 8 on the carrier wheel.

With such an arrangement, each slipring 18, and hence its associated brush 17, serves three separate pallets in turn, in time-spaced succession, and each successive pallet on the carrier wheel is energised in correct succession as it becomes submerged in the electro-coating fluid, and is subsequently de-energised in correct succession before it leaves that fluid. Since each pallet is served by an individual slipring segment 18B, and since three such segments constitute a single slipring 18, the number of such sliprings 18, and associated brushes 17, is one third of the number of pallets on the carrier wheel.

FIGS. 5 and 6 show such a compact slipring assembly. There, the assembly comprises a number of sliprings 18 which are spaced apart along the insulating bush 34. Each such slipring is made up of three equal conducting segments 18B, each of which is insulated from the others and subtends an angle at its centre of almost 120 degrees. That angle is substantially equal to the angle subtended by the immersed arc of the carrier wheel 3, as indicated in FIG. 2 by the intersection of the free surface 'L' of the electrolyte with the periphery of the carrier wheel 3. That arc encompasses the arcs of carrier wheel travel which have been designated 'T' (test) and 'C' (electro-coating treatment). Corresponding segments 18B in adjacent sliprings 18 are staggered angularly relative to one another by one pallet pitch, as shown in FIG. 6. Hence, the energisation of the respective pallets relative to their respective counter electrodes is timed so as to co-incide with the respective periods during which the associated pallets are travelling submerged in the electro-coating fluid.

In the particular apparatus illustrated in the FIGS. 1 to 6, the carrier wheel has two circles of thirty-six pallets; just over one third of them are immersed in the fluid at any given time; each slipring 18 has three conductive segments; and the number of such sliprings for each circle of pallets is twelve.

The slipring bush 34 is firmly secured on the shaft 4 in a predetermined angular position relative to the carrier wheel such as to achieve the desired electro-coating of each workpiece as it travels through the electro-coating fluid. In the FIGS. 5 and 6, the slipring segments 18B are shown as having connections 18C which pass radially inwards through the insulating bush 34 and then axially so as to protrude from the free end of the slipring assembly as the terminals 18A for receiving the various cables 27.

The manner of interconnecting the various slipring segments 18B and the respective pallets 8A (on one side only of the carrier wheel 3) is as set out below, and as illustrated in the FIG. 7.

The respective segments (18B) 'A', 'B' and 'C' of the respective sliprings 18 are connected to the respective pallets (8A) '1', '2', '3', . . . 'N-1', 'N' in the following manner:

| SEGMENTS A, B, C OF SLIPRING | | PALLET NUMBERS RESPECTIVELY | | |
|---|---|---|---|---|
| 1 | | 1, | N + 1, | 2N + 1 |
| 2 | | 2, | N + 2, | 2N + 2 |
| 3 | ARE CONNECTED TO | 3, | N + 3, | 2N + 3 |
| . | | . | . | . |
| . | | . | . | . |
| . | | . | . | . |
| N − 1 | | N − 1, | 2N − 1, | 3N − 1 |

-continued

| SEGMENTS A, B, C OF SLIPRING | PALLET NUMBERS RESPECTIVELY | | |
|---|---|---|---|
| N | N, | 2N, | 3N |

A similar slipring arrangement is provided for the other circle of pallets 8B.

Each of the slipring segments 18B may be subdivided, if desired, into a short, initial, test portion insulated from a following, longer, electro-coating portion.

The control unit 33 includes in respect of each brush 17: (a) monitoring means 33M for monitoring the electro-coating current passing through the brush to the associated slipring segment 18B, (b) integrating means 33I for integrating that electric current to provide a measure of the electric charge passed so far in the electro-coating process (and hence the amount of electro-coating material so far deposited on the associated workpiece 29), (c) comparison means 33C for comparing the amount of electric charge with a reference signal derived from a reference signal source 33R, and (d) switching means 33S for terminating the flow of electric current to the brush when the charge so far supplied through it has reached the reference level.

The benefits arising from electrically isolating each pallet and workpiece from its neighbours are, firstly, it becomes possible to monitor each workpiece for sound electrical contact with its pallet before commencing the electro-coating treatment, and subsequently to reject any workpiece that is not properly located in its pocket. Secondly, it becomes possible to supply power to only such pallets as contain a correctly seated workpiece, thus avoiding treatment of the workpiece supporting surface in the event that a workpiece is absent from, or incorrectly seated in, the pocket. In the case of electro-coating treatments, a pocket not containing a workpiece, or a pocket having an incorrectly seated workpiece, would become electro-coated with an insulating material, thus making it more difficult to treat a workpiece subsequently properly placed in the pocket. Thirdly, it becomes possible to individually monitor and control the electro-coating of each separate workpiece.

Where the apparatus just described is to be used for electro-coating non-ferrous can ends, that apparatus is modified in the following manner:

(a) each pocket is provided with snap-fit retaining means (not shown) for engaging a can end by its peripheral parts in a snap-fit manner, and for biasing the can end into good electrical contact with the annular contact surface of the pocket bead 28;

(b) each wheel 13 is provided superficially with resilient pads 35, for engaging a can end received in a pocket and for urging it into snap-fit engagement with the pocket;

(c) synchonised ejector wheels 13B, generally similar to the wheels 13, are located adjacent to the inner surfaces of the respective rings of pallets 8, at a position opposite the outfeed conveyor belt 15, for urging successive electro-coated can ends out of the respective snap-fit pockets;

(d) the outfeed conveyor belt 15 is of an open-mesh construction and non-magnetic; and (e) the outfeed conveyor pulley 16 incorporates a series of resilient suction cups 36 which protrude through consecutive meshes of the belt 15 and which communicate temporarily via a slide valve arrangement 37 with a vacuum manifold 38 carried concentrically with the pulley 16. Those suction cups are spaced around the pulley 16 so as to come into contact with and grip successive can ends 29 carried in successive pallets 8 as the carrier wheel 3 rotates. On continued synchronised rotation of the carrier wheel 3 and the pulley wheel 16, successive suction cups lift successive can ends out of their respective pockets after being released therefrom by the ejector wheels. The vacuum in each suction cup is maintained until the can end gripped thereby is stably positioned and carried on the upper horizontal part of the belt 15.

It will be appreciated that if only one slipring segment 18B were to be carried on each slipring, each such slipring would, in one example, have a non-conductive surface portion extending around approximately two-thirds of its periphery. In the preferred embodiment described above, that two-thirds of each slipring is usefully occupied by two other similar slipring segments 18B, which feed other pallets 8 that are spaced corresponding distances around the periphery of the carrier wheel 3. Hence, maximum use is made of each slipring 18, and the number of sliprings used is thus greatly reduced compared with what it might otherwise be.

We claim:

1. Electrolytic treatment apparatus for electrolytically treating metal workpieces comprising:

(a) an electrolyte tank for receiving a filling of an electrolyte reaching up to a predetermined electrolyte surface level;

(b) a rotatable carrier wheel carried for rotation on a shaft which lies wholly above said electrolyte surface level, said carrier wheel having part thereof reaching down into said tank, below said electrolyte surface level, so that on rotation of said carrier wheel successive peripheral portions of said carrier wheel travel temporarily below said electrolyte surface level during each revolution of said carrier wheel;

(c) a plurality of workpiece carriers secured on said carrier wheel at positions spaced uniformly around the periphery of said carrier wheel, said workpiece carriers being arranged to receive therein respective workpieces in radially-facing positions;

(d) a counter-electrode disposed in said electrolyte tank below said electrolyte surface level; and (e) energising means for electrically energising said workpiece carriers relative to said counter-electrode from an electrical supply source, thereby in the presence of a said filling of electrolyte in said tank to electrolytically treat workpieces as they are carried temporarily through said electrolyte on rotation of said carrier wheel: which apparatus is characterised in that (i) said workpiece carriers are arranged to receive disc-like workpieces and are electrically insulated from said carrier wheel and from one another; and (ii) said energising means includes (a) a plurality of electrically conductive sliprings carried on said shaft for rotation with said wheel, said sliprings being electrically connected with the respective workpiece carriers, and (b) a plurality of electrical brushes which engage the respective sliprings for electrically energising the respective sliprings and associated workpiece carriers when said brushes are electrically energised relative to said counter-electrode.

2. Electrolytic treatment apparatus according to claim 1, wherein each said slipring is electrically conductive over only a predetermined circumferential portion of its peripheral surface, which portion is positioned in relationship to the associated workpiece carrier and the associated brush so as to electrically energise the associated workpiece carrier only during its travel below said electrolyte surface level during each revolution of said carrier wheel, a complementary circumferential surface portion of the slipring peripheral surface being electrically non-conductive.

3. Electrolytic treatment apparatus according to claim 2, wherein each such conductive surface portion of a slipring is of such circumferential length that the associated workpiece carrier is energised for substantially the whole of the travel of that workpiece carrier below said electrolyte surface level during each revolution of said carrier wheel.

4. Electrolytic treatment apparatus according to claim 2, wherein the non-conductive surface portion of each of a plurality of selected sliprings is replaced in part by a correspondingly-positioned conductive surface portion of at least one other slipring, thereby (a) to energise at least two workpiece carriers in spaced succession from each said selected slipring and its associated brush during each revolution of said carrier wheel, and (b) to reduce the number of separate sliprings and associated brushes otherwise required for energising said workpiece carriers.

5. Electrolytic treatment apparatus according to claim 2, wherein the non-conductive surface portion of each of a plurality of selected sliprings is replaced in part by correspondingly-positioned conductive surface portions of at least two other sliprings, thereby (a) to energise at least three workpiece carriers in spaced succession from a single brush during each revolution of said carrier wheel, and (b) to reduce the number of separate sliprings and associated brushes otherwise required for energising said workpiece carriers.

6. Electrolytic treatment apparatus according to claim 2, wherein the non-conductive surface portion of each of a plurality of selected sliprings is replaced in part by a plurality of correspondingly-positioned conductive surface portions of respective other sliprings, thereby (a) to energise a plurality of workpiece carriers in spaced succession from each said selected slipring and its associated brush during each revolution of said carrier wheel, and (b) to reduce the number of separate sliprings and associated brushes otherwise required for energising said workpiece carriers.

7. Electrolytic treatment apparatus according to claim 6, wherein (a) said carrier wheel carries 'x.N' workpiece carriers, where 'x' and 'N' are both integral, (b) said electrolyte surface level is positioned such that at least 'N' workpiece carriers lie below said electrolyte surface level, (c) the number of said conductive surface portions per slipring is 'x', and (d) the number of sliprings is 'N'.

8. Electrolytic treatment apparatus according to claim 7, wherein (a) said carrier wheel carries '3N' workpiece carriers, (b) said electrolyte surface level is positioned such that at least 'N' workpiece carriers lie below said electrolyte surface level, (c) the number of said conductive surface portions per slipring is 3, and (d) the number of sliprings is 'N'.

9. Electrolytic treatment apparatus according to claim 1, wherein (i) said carrier wheel comprises (a) a pair of discs spaced apart to define between them an annular cavity, and (b) a generally cylindrical peripheral member secured to said discs so as to encircle said annular cavity, (ii) each said workpiece carrier is secured to said cylindrical peripheral member so as to extend sideways from said carrier wheel, and (iii) each said workpiece carrier incorporates an aperture which defines a workpiece pocket for receiving and supporting the peripheral part of a disc-like workpiece thereby to expose opposite radially-facing surfaces of the workpiece to electrolyte.

10. Electrolytic treatment apparatus according to claim 9, wherein half of said workpiece carriers are arranged so as to extend to one side of said carrier wheel, and the other workpiece carriers are arranged to extend to the opposite side of said carrier wheel.

11. Electrolytic treatment apparatus according to claim 10, wherein said counter electrode comprises two arcuate electrodes disposed respectively on opposite sides of said carrier wheel, each such arcuate electrode being disposed concentrically with an adjacent circle of carrier members extending from said carrier wheel.

12. Electrolytic treatment apparatus according to claim 9, wherein each said workpiece pocket includes an annular contact surface arranged so as to electrically contact a peripheral exposed edge portion of a workpiece.

13. Electrolytic treatment apparatus according to claim 9, wherein said cylindrical peripheral member of said carrier wheel carries a plurality of electrical terminals, to which the respective workpiece carriers and their respective associated sliprings, or conductive surface portions thereof, are electrically connected.

14. Electrolytic treatment apparatus according to claim 13, wherein said shaft has a central bore which communicates with said annular cavity of said carrier wheel, and electrical cables extend through said bore and annular cavity to interconnect said terminals with their respective sliprings, or conductive surface portions thereof.

15. Electrolytic treatment apparatus according to claim 9, wherein said counter-electrode comprises at least one arcuate electrode disposed concentrically with said carrier members.

16. Electrolytic treatment apparatus according to claim 15, wherein said counter-electrode is magnetic and is positioned so as to attract and firmly hold in position ferro-magnetic workpieces when carried in the respective workpiece pockets thereby to ensure good electric contact of said workpieces with the associated workpiece carriers.

17. Electrolytic treatment apparatus according to claim 15, wherein said counter electrode has associated therewith an arcuate magnetic member, which magnetic member is positioned so as to attract and firmly hold in position ferro-magnetic workpieces when positioned in the respective workpiece pockets thereby to ensure good electrical contact of said workpieces with the associated workpiece carriers.

18. Electrolytic treatment apparatus according claim 15, wherein said arcuate counter electrode is disposed radially inwards of the adjacent workpiece carriers.

19. Electrolytic treatment apparatus according to claim 9, wherein said counter electrode comprises at least one arcuate electrode disposed radially inwards of said carrier members, and at least one arcuate electrode disposed radially outwards of said carrier members.

20. Electrolytic treatment apparatus according to claim 9, wherein said cylindrical peripheral member comprises a plurality of axial segments lying circumferentially adjacent one another.

21. Electrolytic treatment apparatus according to claim 1, including (a) an electric current control means arranged for controlling the flow of electric current from a said supply source to the respective brushes; and (b) a circuit testing means for causing a test current to flow via a said brush to the associated workpiece carrier on becoming submerged in an electro-coating fluid, thereby to determine whether a workpiece carried in said carrier is properly seated therein, and to provide an 'inhibit' signal to said current control means in the event that the workpiece is not properly seated in the carrier, thereby to prevent the flow of an electro-coating current to the workpiece whilst it remains so submerged.

22. Electrolytic treatment apparatus according to claim 21, wherein said electric current control means includes for each said brush (a) integrating means for producing a electro-coating signal dependent on the time integral of the electro-coating current flowing to a workpiece through said brush, which signal is representative of the amount of electro-coating material so far deposited on the workpiece; and (b) comparison means for comparing said electro-coating signal with a reference signal and terminating the flow of electro-coating current to said workpiece when said electro-coating signal has reached the reference signal value.

23. Electrolytic treatment apparatus according to claim 1, including in said tank a filling of an electro-coating fluid reaching up to said electrolyte surface level.

* * * * *

UNITED STATES PATENT AND TRADEMARK OFFICE

CERTIFICATE OF CORRECTION

PATENT NO. : 4,909,917

DATED : March 20, 1990

INVENTOR(S) : Harrison et al.

It is certified that error appears in the above-identified patent and that said Letters Patent is hereby corrected as shown below:

On the title page item [73], "Assignee":

"CMP Packaging (UK) Limited" should read:

-- CMB Packaging (UK) Limited -- .

Signed and Sealed this

Twenty-fourth Day of September, 1991

*Attest:*

HARRY F. MANBECK, JR.

*Attesting Officer*

*Commissioner of Patents and Trademarks*